United States Patent [19]

Brzytwa

[11] 4,024,907

[45] May 24, 1977

[54] SEALING PLATE SUPPORT

[75] Inventor: Tadek Brzytwa, Wellsville, N.Y.

[73] Assignee: The Air Preheater Company, Inc., Wellsville, N.Y.

[22] Filed: Jan. 8, 1976

[21] Appl. No.: 647,523

[52] U.S. Cl. ..... 165/9

[51] Int. Cl.[2] ..... F28D 19/04

[58] Field of Search ..... 165/9, 8

[56] References Cited

UNITED STATES PATENTS

| | | | |
|---|---|---|---|
| 3,010,703 | 11/1961 | Bellows et al. | 165/9 |
| 3,010,704 | 11/1961 | Egbert | 165/9 |
| 3,250,316 | 5/1966 | Nyberg | 165/9 |
| 3,301,317 | 1/1967 | Weaving et al. | 165/9 X |
| 3,373,797 | 3/1968 | Nyberg | 165/9 |
| 3,785,431 | 1/1974 | Pettersson et al. | 165/9 |
| 3,786,868 | 1/1974 | Finnemore | 165/9 |
| 3,942,953 | 3/1976 | Gentry | 165/9 X |

*Primary Examiner*—Carroll B. Dority, Jr.
*Assistant Examiner*—Sheldon Richter
*Attorney, Agent, or Firm*—Wayne H. Lang

[57] ABSTRACT

An adjusting means for rotary regenerative heat exchange apparatus by which a sealing plate that lies adjacent an end of a rotor containing a mass of heat absorbent element is adjusted axially to maintain a closely spaced relationship whereby there will be a minimum clearance space to permit fluid leakage therebetween.

6 Claims, 2 Drawing Figures

SEALING PLATE SUPPORT

BACKGROUND OF THE INVENTION

1. Field of the Invention

This invention relates to rotary regenerative heat exchangers and it has particular relation to an arrangement by which plates at the ends of a rotor are adjusted axially to provide an optimum relationship whereby they will be closely spaced to permit a minimum of fluid leakage through the space therebetween.

2. Description of Prior Art

In rotary regenerative heat exchange apparatus of the type herein disclosed it is usually necessary that an adjusting means for an axially movable sector plate include an arrangement whereby one side thereof may be completely isolated from the other so there will be no leakage of corrosive gases and fly-ash thereby. Such a complete sealing requirement has resulted in the development of a bellows-type seal of the type shown in U.S. Pat. No. 3,246,688 of A. Jensen, et al., granted on Apr. 9, 1966.

Although a bellows-type seal of the type disclosed in this patent is effective, it is also expensive to manufacture and to install, and it is especially susceptible to excessive corrosion and erosion.

Moreover, its replacement and repair is time consuming and expensive, and it does not adapt itself to the continuous monitoring of its operational characteristics.

SUMMARY OF THE INVENTION

In accordance with the present invention, I therefore provide a novel type sealing device that effectively replaces a bellows-type seal. More particularly, the present invention relates to an adjustable sealing device that positively isolates one side of a sealing plate from the opposite side thereof. The sealing device disclosed herein is basically simple and economical to install or to replace, and it may be easily adjusted axially to achieve an optimum sealing relationship between the relatively movable parts of a rotor and the surrounding housing structure.

THE DRAWING

Further details of the invention are hereinafter described with reference to the figures of the accompanying drawings in which:

FIG. 1 is a sectional side elevation of a rotary regenerative heat exchanger involving the present invention, and FIG. 2 is a enlarged side elevation, partially broken away, to show the seal adjusting means.

DESCRIPTION OF THE PREFERRED EMBODIMENT

Figure 1:
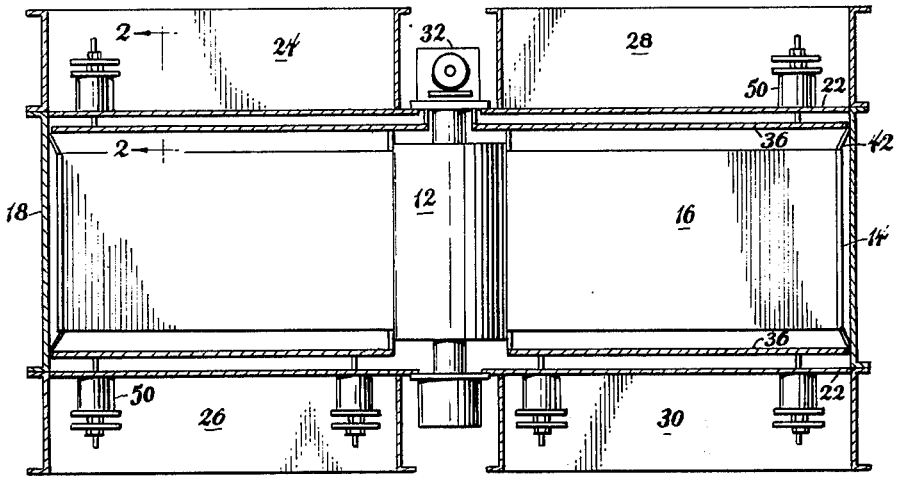
Figure 2:
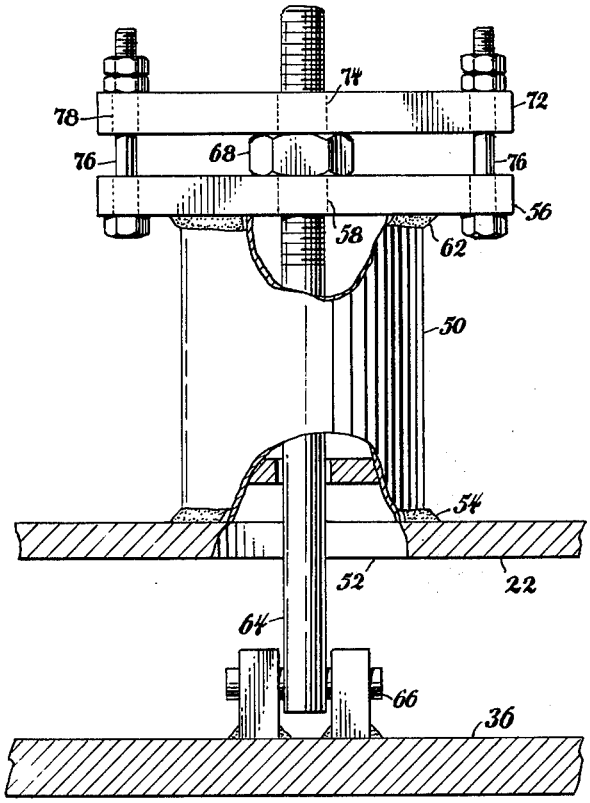

Referring to the drawings a rotary regenerative heat exchanger is shown as a rotor having a central rotor post 12 and a concentric shell 14 spaced therefrom to provide an annular space therebetween that is packed with a mass of heat absorbent material 16.

Housing 18 encloses the rotor and includes connecting plates 22 at opposite ends thereof that are in turn connected to spaced inlet and outlet ducts 24, 26, 28 and 30 that direct a heating fluid and a fluid to be heated through spaced parts of the rotor as it is rotated about its axis by means such as a motor 32.

When so rotated, the heat absorbent material carried by the rotor is alternately positioned in a hot gas stream and a cool air stream in order that heat from the hot gas may be transferred to the cool air through the intermediary of the heat absorbent material 16.

The housing 18 encloses the rotor in spaced relation thereto while sector-shaped end plates 36 at opposite ends of the rotor lie intermediate air and gas ducts and between ends of the rotor and the connecting plates to preclude by-passing the rotor by the gas and air as they are directed through the spaced ducts.

In order that leakage of one fluid stream to the other is kept at a minimum, it is essential that the plates 36 be moved into closely spaced relation with the adjacent face of the rotor whereby said plates will be spaced sufficiently so as not to cause frictional contact therebetween, but not so far as to make a wide gap that would cause excessive fluid leakage.

To preclude by-passing the rotor by hot gas and cool air, adjusting means for the sector-shaped end plates are therefore provided at each end of the rotor intermediate the air and gas ducts to move the plates axially to their optimum relationship. Moreover, it is customary to provide circumferential seals 42 at the end of the rotor shell and radial seals that extend across the face of the rotor to confront the adjacent sector-shaped end plates in a sealing relation that precludes excessive leakage of gas and air thereby.

According to this invention, each sector plate 36 is supported at the radial outboard end or at the outboard and inboard ends by plate adjusting means 50. When a single plate adjusting means 50 is used in the manner shown at the upper end of FIG. 1, the adjusting means is positioned at the outboard end of the plate 36, while the inboard end thereof is supported by fixed housing structure. This arrangement requiring an adjusting means only at the outboard end of sector plate 36 is suitable at an end of the heat exchanger where there is a minimum of thermal distortion; however, at an end of the apparatus where there is a maximum amount of thermal distortion, a plurality of adjusting means 50 are provided at both the radial inboard and outboard ends to provide a floating sector plate 36 that is completely adjustable in the manner shown adjacent ducts 26 and 30 of FIG. 1.

Each adjusting means comprises what is essentially a cylindrical housing 50 that is placed over an opening 52 in sector plate 22 and welded thereto by an annular weld 54. A lower compression plate 56 having a central opening 58 is welded at 62 to the upper end of housing 50 to provide an apertured housing through which an adjusting rod 64 may be directed. The rod 64 is pivotally secured to plate 36 by a hinged connection 66 at one end, while the distal end thereof extends through aligned openings 52, 58, and 74 in the sector plate 22 and in the plates at the end of housing 50.

The rod 64 is threaded at the outer end thereof to receive a nut 68 that rests on the lower compression plate 56 to cover the opening 58 therein to provide a sealing means that precludes the passage of fluid therethrough. Rotation of nut 68 moves it along the rod 64 to raise or lower the plate 36 to any predetermined location whereby there will be an optimum clearance space between plate 36 and the adjacent end of the rotor.

In order that the nut 68 may be restrained against movement while it continuously covers the opening 68 in the lower compression plate 56 to seal the fluid in housing 50, an upper compression plate 72 with a central opening 74 is adapted to combine with the lower plate 56 to clamp the nut 68 therebetween. Bolts 76 that extend through aligned openings 78 in the lower and upper compression plates 56 and 72 are accordingly tightened to effect a visc grip on the nut 68 and thus preclude leakage of fluid from the space within housing 50.

While the device of this invention has been defined with respect to the drawing, it should be understood that various changes could be made with respect to the form of the apparatus or its express location without departing from the essence of the invention. It is, therefore, to be understood that the embodiment shown is illustrative only and not restrictive of the invention.

I claim:

1. Regenerative heat exchange apparatus including a cylindrical rotor shell and a central rotor post concentrically arranged to provide an annular space therebetween, a mass of heat absorbent material carried in the annular space of the rotor, a housing surrounding the rotor in spaced relation including fixed connecting plates at opposite ends of the rotor having inlet and outlet ducts for a heating fluid and a fluid to be heated, sector-shaped sealing plates intermediate the rotor and adjacent connecting plate adpapted to preclude bypassing the rotor by said fluids, plate adjusting means connecting the sealing plates to the housing structure for movement axially between a connecting plate and the rotor including an aperture extending through said connecting plate, a rigid cylindrical housing affixed to the outboard side of the connecting plate around the periphery of said aperture, a threaded actuating rod attached to said sealing plate and extending through the cylindrical housing, and an adjusting nut threaded to said actuating rod and adapted to bridge the annular space lying intermediate the actuating rod and the cylindrical housing to move the actuating rod and the sealing plate connected thereto axially into an axial relationship that precludes fluid flow between the end of the rotor and said sealing plate when the adjusting nut is rotated about the threaded actuating rod.

2. Regenerative heat exchange apparatus as defined in claim 1 including pivotal means intermediate the actuating rod and the sealing plate.

3. Regenerative heat exchange apparatus as defined in claim 1 wherein the adjusting nut covers the end of the cylindrical housing to preclude the flow of fluid therethrough.

4. Regenerative heat exchange apparatus as defined in claim 1 having a first plate lying across the end of the cylindrical housing with a central aperture therein adapted to receive the end portion of the actuating rod, and a second plate means lying parallel to said first plate adapted to hold the adjusting nut therebetween.

5. Regenerative heat exchange apparatus as defined in claim 4 including means that tightly holds the first and second plate means with the adjusting nut therebetween.

6. Regenerative heat exchange apparatus as defined in claim 5 wherein a plate adjusting means lies adjacent the radial outboard end of each sealing plate.

* * * * *